US005447191A

United States Patent [19]

Boula

[11] Patent Number: 5,447,191

[45] Date of Patent: Sep. 5, 1995

[54] HEAT EXCHANGER INCLUDING MEANS FOR HOLDING ANTIVIBRATION BARS INTERPOSED BETWEEN THE TUBES OF THE BUNDLE OF THE EXCHANGER

[75] Inventor: Gerard Boula, Corpeau, France

[73] Assignee: Framatome, Courbevoie, France

[21] Appl. No.: 292,824

[22] Filed: Aug. 19, 1994

[30] Foreign Application Priority Data

Aug. 20, 1993 [FR] France ..... 93 10158

[51] Int. Cl.[6] ..... F28F 9/013

[52] U.S. Cl. ..... 165/69; 165/162; 122/510

[58] Field of Search ..... 165/69, 162; 122/510

[56] References Cited

U.S. PATENT DOCUMENTS

| | | | |
|---|---|---|---|
| 2,853,278 | 9/1958 | Hesler | 206/593 |
| 3,575,236 | 4/1971 | Romanos | 165/162 |
| 4,839,951 | 6/1989 | Boula | 165/69 X |
| 5,005,637 | 4/1991 | Gentry | 165/69 |
| 5,042,433 | 8/1991 | Monnier | 122/510 |

FOREIGN PATENT DOCUMENTS 467755 1/1992 European Pat. Off. .

*Primary Examiner*—Martin P. Schwadron
*Assistant Examiner*—L. R. Leo
*Attorney, Agent, or Firm*—Pollock, Vande Sande & Priddy

[57] ABSTRACT

The heat exchanger includes at least one metal retainer hoop (20) having a shape similar to the shape of the bent parts (5b) of the tubes of the bundle, fixed at each of its ends on the spacer plate (10a) located closest to the bent parts (5b) of the tubes, in extension of two anchor rods, (14) and interposed between two successive tubes of a plane row of tubes (18) and including linkage devices (22) for fastening the set of antivibration bars (13) interposed between two adjacent tube rows.

9 Claims, 4 Drawing Sheets

HEAT EXCHANGER INCLUDING MEANS FOR HOLDING ANTIVIBRATION BARS INTERPOSED BETWEEN THE TUBES OF THE BUNDLE OF THE EXCHANGER

FIELD OF THE INVENTION

The invention relates to a heat exchanger and, in particular, a steam generator of a pressurized water nuclear reactor including means for holding antivibration bars interposed between the tubes of the bundle of the exchanger.

BACKGROUND OF THE INVENTION

Steam generators of pressurized water nuclear reactors include tubes bent in a U having two straight parts or linear branches clamped at their ends in a tube plate. The linear branches of the tubes of the bundle are held are held by spacer plates arranged mutually parallel and distributed along the length of the linear branches and each including a network of through-openings for allowing passage of the tubes.

The networks of openings of the tube plate and of the spacer plates are identical and the openings are arranged in these networks so that the tubes of the bundle constitute parallel plane rows having a small spacing.

In each of the rows, the bends of substantially semicircular shape are juxtaposed and have radii of curvature which decrease from the outside towards the inside of the bundle. In addition, the bends of each of the rows which have the maximum radius of curvature have a radius which decreases from the central part towards the peripheral part of the bundle.

For this reason, the bent parts of the tubes constitute a substantially hemispherical shape called the tube bend region at the upper part of the steam generator bundle.

The tubes of a given row and the adjacent rows are separated by narrow free spaces allowing passage of feedwater of the steam generator inside the bundle, in contact with the outer exchanger surface of the tubes.

During operation of the steam generator, the pressurized water at high temperature circulates in the tubes of the bundle and the feedwater is brought into contact with the outer exchange surface of the tubes along which it moves in the vertical direction while being heated, and then vaporizes, to emerge in the form of steam in the upper part of the steam generator.

The circulation of the fluids in contact with the tubes may cause vibrations which can lead to damage of the tubes if they are not held efficiently.

The linear part of the tubes is held efficiently by rigid spacer plates. The curved parts of the tubes of the bundle constituting the tube bend region must also be held and antivibration bars which generally used for this purpose which are interposed between the adjacent tube rows of the bundle and arranged along substantially radial directions of the tube bend region. These spacer bars may be folded or assembled so as to have the shape of a V whose two branches are directed, in use, along radial directions of the tube bend region between the tube rows of each of the adjacent row pairs.

The bundle of the steam generator is assembled by successive rows, in the casing of the steam generator which is placed in the horizontal position on a turning gear.

Most of the operations of mounting and welding the elements of the steam generator are also carried out with the steam generator in a horizontal position.

During mounting of the bundle, the antivibration bars, which are introduced between the tube rows so that their branches have well-defined radial arrangements with respect to the tube bend region are capable of sliding and tilting, so that there is a risk that they will be fitted incorrectly.

At the end of the mounting of the bundle, the ends of the antivibration bars opposite their ends located in the central part of the tube bend region generally project with respect to the tubes which constitute the outer layer of the tube bend region and are connected together by curved bars resting on the outer surface of the tube bend region and on which the outer end parts of the antivibration bars are welded.

Other known modes of fastening the outer ends of the antivibration bars employ removable fastening elements such as screwed elements.

Insofar as the curved bars or other devices for holding the outer ends of the antivibration bars are fitted only after all the tubes of the bundle have been mounted, the antivibration bars are not held with respect to each other during the manufacturing phases subsequent to mounting of the bundle, for example during welding of the bottom of the steam generator constituting the water box or during final welding of the steam generator as a result tilting of the bars or other displacements can arise during the manufacture and lead to positioning defects of the antivibration bars and bending of the tube rows this, in turn leads to the presence of shape defects of the tube bend region of the steam generator.

Furthermore, during operation of the steam generator, the antivibration bars which are in contact with a fluid circulating at high speed may be displaced within the tube bend region, because they are connected together only by their outer ends and by linkage devices located above the surface of the tube bend region.

The spacer plates which hold the linear parts of the tubes of the steam generator are fixed to anchor rods which are perpendicular to the spacer plates and pass through them inside openings substituting for tube passage openings in the networks of the spacer plates.

Each of the anchor rods is fixed, by mechanical assembly parts to the upper spacer of the steam generator, i.e., to the spacer located closest to the bent part of the tubes of the bundle.

In extension of the anchor rods, inside the tube bend region, free spaces are left which are arranged between two successive tubes of one and the same row, because of the presence of the anchor rods within the bundle, in positions which might be occupied by tubes. The bundle of the steam generator therefore has certain discontinuities within the tube bend region, in extension of the anchor rods.

To date, no device has been known which makes it possible to mount the bundle of a steam generator while avoiding tilting or other displacement of the antivibration bars for holding the bent parts of the tubes, both during the manufacturing operations following the mounting of the tubes and during operation of the steam generator.

SUMMARY OF THE INVENTION

The object of the invention is therefore to provide a heat exchanger including a bundle of heat-exchange tubes bent in a U and each comprising two straight parts and a bent part, a tube plate and a plurality of spacer plates which are mutually parallel and spaced along the longitudinal direction of the straight parts of the tubes, in which plates the tubes of the bundle are engaged inside through-openings which hold the tubes in mutually parallel plane rows, anchor rods for holding the spacer plates, which rods are arranged inside the bundle, parallel to the straight parts of the tubes, and sets of antivibration bars interposed between the bent parts of the tubes and arranged along the adjacent rows, this heat exchanger having a design making it possible to improve the fitting and holding of the antivibration bars and of the tubes, during the mounting of the bundle, as well as the holding of the antivibration bars both during manufacture, and during operation of the heat exchanger.

To this end, the heat exchanger according to the invention furthermore includes, for holding at least one set of antivibration bars arranged between the tubes of two adjacent rows, at least one metal retainer hoop having a shape similar to the shape of the bent parts of the tubes of the bundle, fixed at each of its ends to the spacer plate located closest to the bent parts of the tubes, in extension of two anchor rods, and interposed between two tubes of a row of tubes and including means for fastening the set of antivibration bars interposed between the row in which the retainer hoop is arranged and at least one adjacent row.

BRIEF DESCRIPTION OF THE DRAWINGS

In order better to explain the invention, a description will now be given, by way of example, with reference to the attached drawings, of a steam generator of a pressurized water nuclear reactor according to the invention.

DETAILED DESCRIPTION

Figure 1:
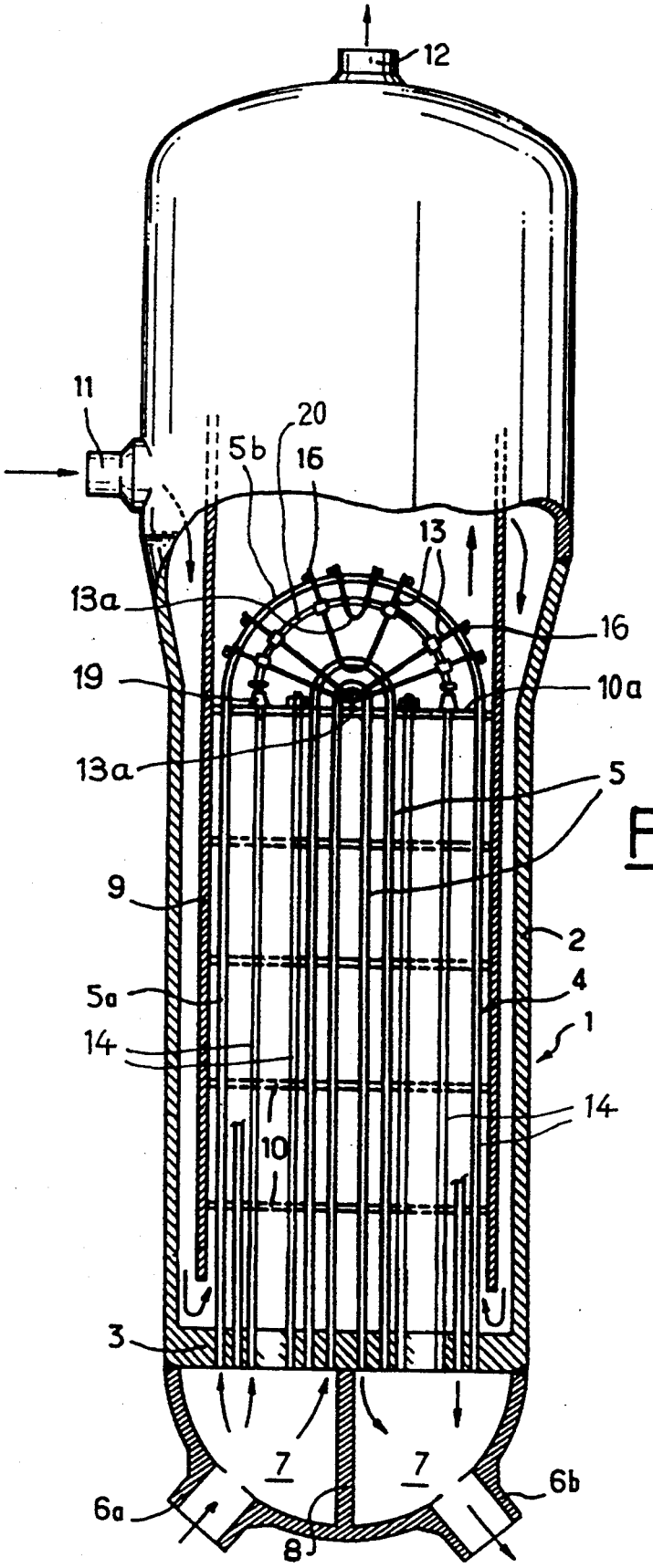
FIG. 1 is a view in exploded perspective and in partial section of a pressurized water nuclear reactor steam generator according to the invention.

FIG. 1 shows a steam generator 1 of a pressurized water nuclear reactor which includes an outer casing 2 connected at its lower part to a thick tube plate 3.

The casing 2 contains the tube bundle of the steam generator consisting of the tubes 5 bent into U-shape and including, at their upper part, semicircular bends **5*b* and two straight parts 5*a***.

The straight parts **5*a* of the tubes of the bundle are clamped at their ends in the tube plate 3, so as to emerge in a water box 7 comprising two parts separated by a partition 8**.

The pressurized water of the nuclear reactor penetrates into one of the parts of the water box 7 through an inlet nozzle **6*a*, circulates in the tubes of the bundle and reemerges through an outlet nozzle 6*b***.

The tube bundle 5 is surrounded by a bundle wrapper 9 making it possible to channel the feedwater entering the casing of the steam generator through an inlet nozzle 11. The feedwater of the steam generator first circulates downwards in the annular space located around the bundle wrapper 9, then upwards in contact with the tubes 5 of the bundle, so as to be heated, then vaporized, and reemerges in the form of steam through the upper nozzle 12 of the steam generator.

The upper part of the tube bundle 5 consists of the juxtaposition of semicircular-shaped bends whose radii decrease from the outside towards the inside of a plane row, as represented in FIG. 1.

In addition, the various successive mutually parallel rows of tubes include outer bends with decreasing diameters, so that the upper part of the bundle constitutes an assembly of substantially hemispherical shape, called the tube bend region.

The straight bars **5*a* of the tubes 5 are held by spacer plates 10 which prevent the tubes from vibrating when the steam generator is in service, under the effect of the circulation of the exchange fluids. The spacer plate 10*a* located uppermost in the steam generator, just below the bends 5*b***, is called the upper spacer plate of the steam generator.

The tube plate 3 and the spacer plates 10 are pierced by a network of through-openings allowing passage of the straight branches **5*a* of the tubes 5, for fastening them or holding them in an arrangement such that the branches 5*a* of the tubes are all mutually parallel and arranged in the axial direction of the bundle, which is the vertical direction when the steam generator 1** is in service in the nuclear reactor.

In addition, the tubes 5 are arranged in mutually parallel plane rows, because the tube plate 5 and the spacer plates 10 are pierced with openings aligned along successive straight rows. The two branches of each of the tubes are engaged in two aligned openings of a given row, which are arranged on either side of the central part of the spacer plates and of the tube plate. The network of openings of the tube plate and of the spacer plates also constitutes straight rows in a direction perpendicular to the parallel rows of tubes, so that the bent tubes are also aligned in a direction perpendicular to the section plane of FIG. 1.

The bent tubes with smaller radius of curvature located in the central part of the bundle define a central free lane inside the bundle, on either side of which the straight parts of the tubes are arranged symmetrically.

The bent parts of the tubes located at the upper end of the bundle are held by antivibration bars 13 which each include two branches connected together at the central part **13*a* of the antivibration bar located inside the bundle. The two branches of each of the antivibration bars may be connected together in articulated fashion and thus constitute a compass-shaped part or be made in the form of a bent bar whose central part 13*a*** constitutes the folded part.

The ends of the branches of the antivibration bars 13 opposite the central part **13*a*, which project slightly with respect to the outer layer of tubes of the tube bend region, are welded on annular holding parts 16** located above the surface of the tube bend region.

The spacer plates 10 are held inside the bundle 4 in arrangements which are mutually parallel and spaced along the length of the linear branches **5*a* of the tubes of the bundle, by anchor rods 14 arranged inside the bundle 4 in arrangements parallel to the linear branches 5*a* of the tubes 5**.

The anchor rods 14 are fixed in the tube plate 3 and pass through each of the spacer plates 10 inside an opening of the network of through-openings of the tubes 5.

The anchor rods 14 are fixed on each of the spacer plates 10 which they pass through, at the level of the corresponding through-opening, for example by mechanical devices and/or by welds.

The straight anchor rods 14 are fixed at their upper part on the upper spacer plate 10*a*, by means of mechanical devices such as nuts and locking washers fixed on a threaded end part of the anchor rod 14 which projects above the upper spacer plate 10*a*. The fastening of the anchor rods 14 by nuts is supplemented by welds, so as to ensure locking and undetachability of the fastening parts.

Figure 2:
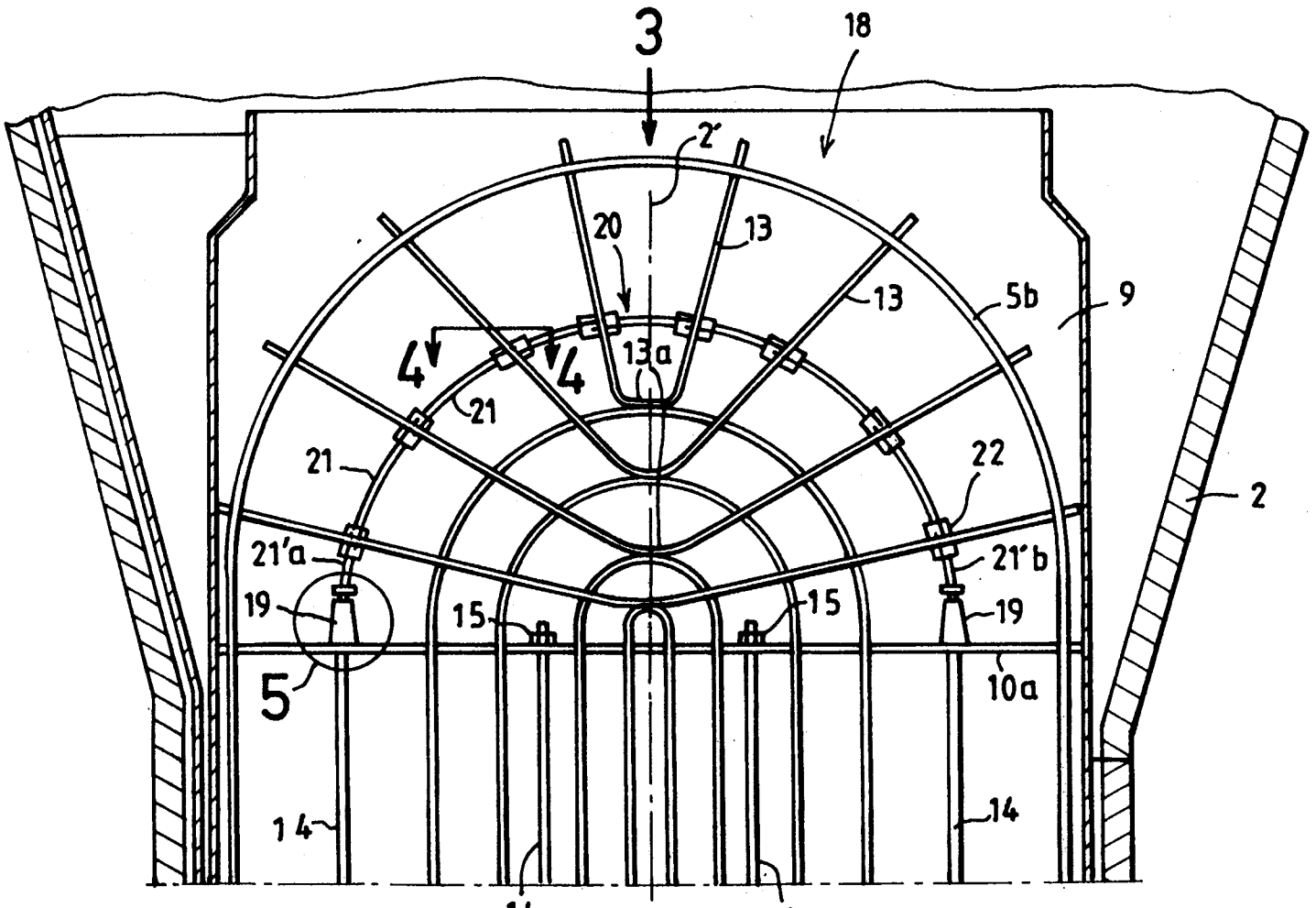
FIG. 2 is a view in section of the upper part of the bundle of the steam generator represented in FIG. 1.

FIGS. 1 and 2 show a few tubes 5 of a plane row 18 located in the vicinity of the central part of the bundle of the steam generator and a set of four V-shaped antivibration bars 13, each including two straight branches arranged in substantially radial directions inside the tube bend region of the bundle 4, in contact with the tubes 5 of the plane row 18.

The four antivibration bars 13, the branches of which form variable angles with each other, constitute a set or group of antivibration bars which is interposed between two adjacent rows 18 of tubes 5 of the bundle. The antivibration bars 13 are engaged to greater or lesser depth inside the tube bend region of the bundle 4, so that the successive branches of the various antivibration bars form substantially constant angles with each other.

In the embodiment represented, the set of antivibration bars includes four bars and eight branches.

During mounting of the bundle of the steam generator, by engaging the tubes 5 inside the openings of the spacer plates 10 and of the tube plate 3, the plane rows 18 are successively constructed by juxtaposing the tubes 5, the casing 2 of the steam generator being placed with its axis of symmetry 2' in a horizontal direction.

The antivibration bars 13 of a set of bars intended to come into contact with a plane row 18 of tubes are fitted on the row 18 which has just been constructed. Furthermore, because they are not fixed together by the fastening rings 16, the antivibration bars 13 which are not held risk tilting about their inner part 13*a*, between the two tube rows 18 with which they are in contact, when the steam generator is rotated about its axis 2' on the rollers of the turning gear, in order to carry out various mounting or welding operations.

According to the invention, the sets of antivibration bars 13 interposed between certain tube rows 18 can be immobilized in a precise mounting position, by using a metal retainer hoop 20 having a shape similar to the shape of the bent parts 5*b* of the tubes 5, i.e., to a substantially semicircular shape.

The retainer hoop 20 is fixed by devices 19 which are described in more detail in the rest of the description, on the upper spacer plate 10*a* of the steam generator, in extension of two anchor rods 14 for holding the spacer-plates 10.

The tube row 18 represented in FIGS. 1 and 2 includes tubes 5 engaged in aligned openings of the spacer plates 10 and of the tube plate 3, two of these openings being reserved for passage and fastening of two holding anchor rods 14.

In the tube bend region of the bundle 4, a space is left between two neighboring tubes of the row 18, in extension of the anchor rods 14, which space makes it possible to interpose the retainer hoop 20 for fastening the antivibration bars 13.

The retainer hoop 20 consists of successive segments 21 in the form of circular arcs. The segments 21'*a* and 21'*b* located at the ends of the retainer hoop 20 are fixed above the upper face of the upper spacer plate 10*a*, by means of fastening devices 19.

The successive segments 21 of the retainer hoop 20, between the segments 21'*a* and 21'*b*, are connected together end-to-end and to the antivibration bars 13 by linkage devices 22 which will be described in more detail with reference to FIG. 4.

Figure 4:
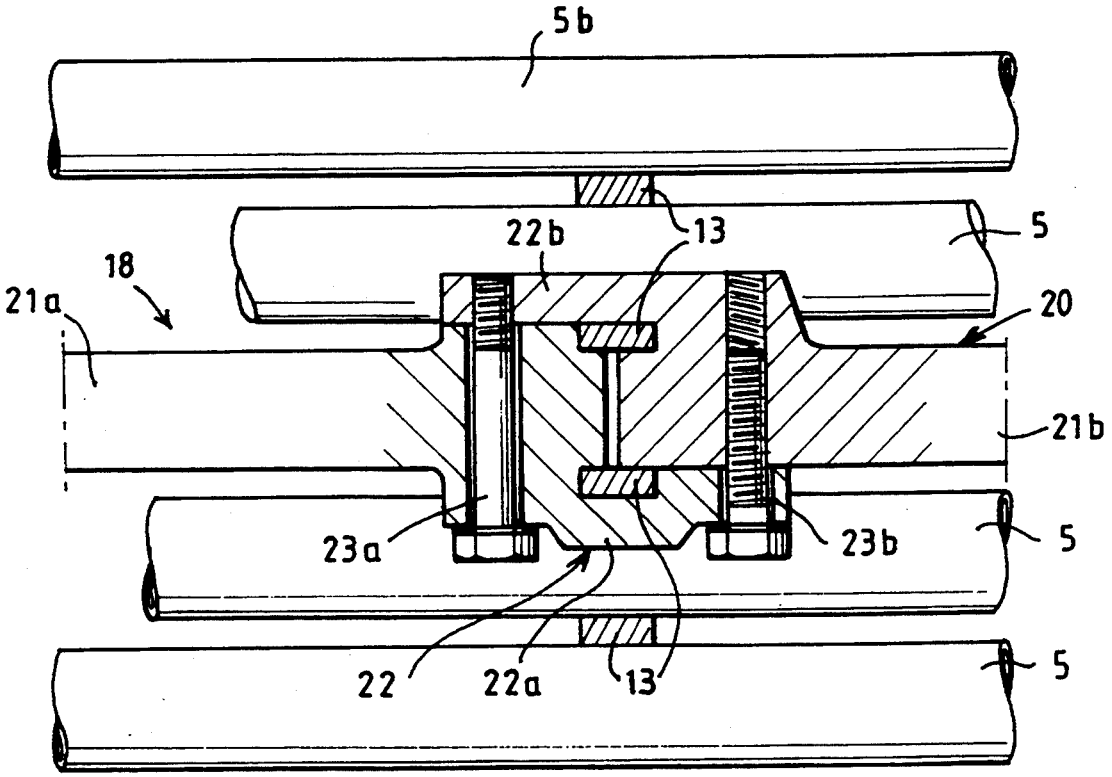
FIG. 4 is a plan view along line 4—4 in FIG. 2.

FIG. 4 shows two successive segments 21*a* and 21*b* of the retainer hoop 20 at the level of a zone 22 for linking the segments 21 together and with two branches of antivibration bars 13 inserted between tubes 5 of adjacent rows of the bundle of the steam generator.

The segments 21*a* and 21*b* are cut out in the form of circular arcs and each include a fork joint at their ends located opposite the level of the linkage zone 22. The fork joints 22*a*, 22*b* of each of the segments 21*a* and 21*b* are placed opposite each other and opposite an end part of the segment on which they are to be assembled.

The end parts of the segments 21*a* and 21*b* and of the fork joints 22*a* and 22*b* are passed through by openings having a threaded part.

The fork joints 22*a* and 22*b* are laterally offset with respect to the mid-plane of the corresponding segments 21*a* and 21*b*, so that, in the assembly position of the segments 21*a* and 21*b*, a space is left between the fork joint 22*a* of the segment 21*a* and the segment 21*b* and between the fork joint 22*b* of the segment 21*b* and the segment 21*a*, allowing introduction and fastening of a branch of an antivibration bar 13.

Because the retainer hoop 20 is arranged inside a tube row 18, between two tubes separated by a space due to the presence of an anchor rod, the fork joints 22*a* and 22*b* and the retainer hoop segments 21*a* and 21*b* can fasten two branches of antivibration bars 13 interposed in two spaces between the row 18 and an adjacent row, on both sides of the row 18.

The successive segments such as 21*a* and 21*b* of the retainer hoop 20 are assembled together by screws such as 23*a* and 23*b*. The two branches of antivibration bars 13 arranged on either side of the row of tubes 18 are clamped and held firmly between the fork joints and the end parts of the segments.

Figure 5:
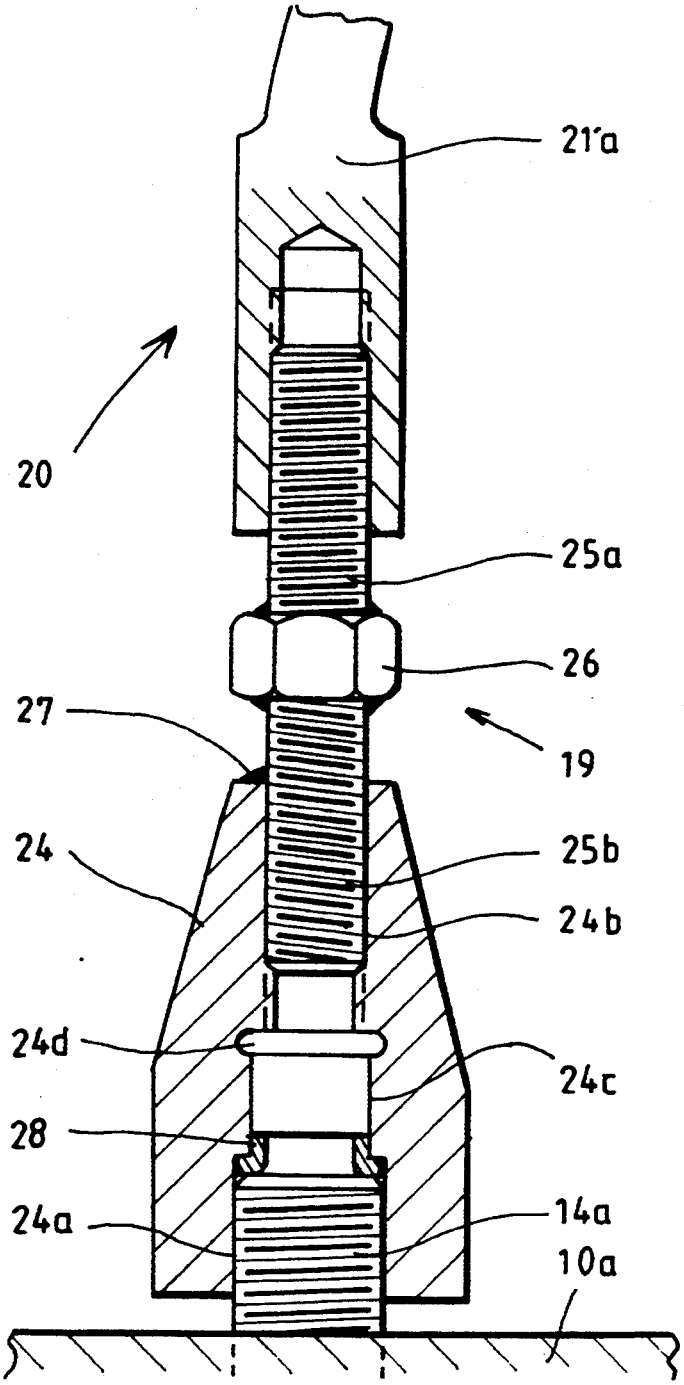
FIG. 5 is a view on a larger scale in section through a vertical plane of the detail 5 in FIG. 2.

As shown by FIG. 5, the device 19 for fastening an end segment such as 21'*a* of the retainer hoop 20 includes a first element 24 passed through by two successive tapped openings 24*a*, 24*b* having the same axis, a threaded rod 25 integral with a nut 26 and a second element consisting of the end part of the segment 21'*a* in which a tapped hole is machined.

The device 19 including the first element 24, the second element 21'*a* and the rod 25 constitutes a tensioner making it possible to exert tension on one end of the retainer hoop 20 and fasten this retainer hoop on the upper spacer plate 10*a*.

The first element 24 includes, along its axis, a first tapped opening 24*a* and a second tapped opening 24*b* with a diameter smaller than the diameter of the tapped opening 24*a*, which are separated by a smooth intermediate opening 24*c* having a diameter intermediate between the diameter of the openings 24*a* and 24*b* and by a groove 24*d*.

The anchor rod 14, in extension of which one end of the ring 20 will be placed, includes a threaded end part 14*a* which will project above the upper spacer plate 10*a*. The tapped opening 24*a* of the element 24 has a diameter and a thread making it possible to fasten the element 24 on the end part 14*a* of the anchor rod 14 by screwing. Prior to fastening of the element 24 on the end 14*a* of the anchor rod 14 by screwing, a locking and stop part 28 is placed inside the intermediate opening 24*c*, on which part 28 the part 14*a* for the anchor rod will abut during the screwing of the element 24.

The rod 25 includes two threaded parts 25*a* and 25*b* having reverse threads, on either side of the nut 26.

The end segment 21'*a* of the retainer hoop 20 includes a tapped opening whose diameter and thread allow screwing of the part 25*a* of the rod 25.

The tapped opening 24*b* has a diameter and a thread allowing screwing of the part 25*b* of the rod 25.

After fastening by screwing and clamping of the part 24, by means of its tapped opening 24*a* onto the end part 14*a* of the anchor rod 14, the rod 25 is screwed into the tapped opening 24*b* of the element 24 by its part 25*b* and into the tapped opening of the end segment 21'*a* of the retainer hoop, by its part 25*a*.

The retainer hoop 20 is tensioned and fastened by means of the nut 26 of the device 19 which constitutes a tensioner.

The ring 20 can therefore be fitted during mounting of the bundle, by assembling the successive segments 21 of the ring together and with the antivibration bars arranged on either side of the tube row being mounted; the fastening devices 19 at each of the ends of the retainer hoop 20 are fitted and clamped so as to tension the retainer hoop 20 and fasten in place the two sets of antivibration bars 13 arranged on either side of the tube row 18.

The rod 25 can be locked with respect to the part 24 by a weld 27, at the end of the clamping and tensioning of the ring.

Figure 3:
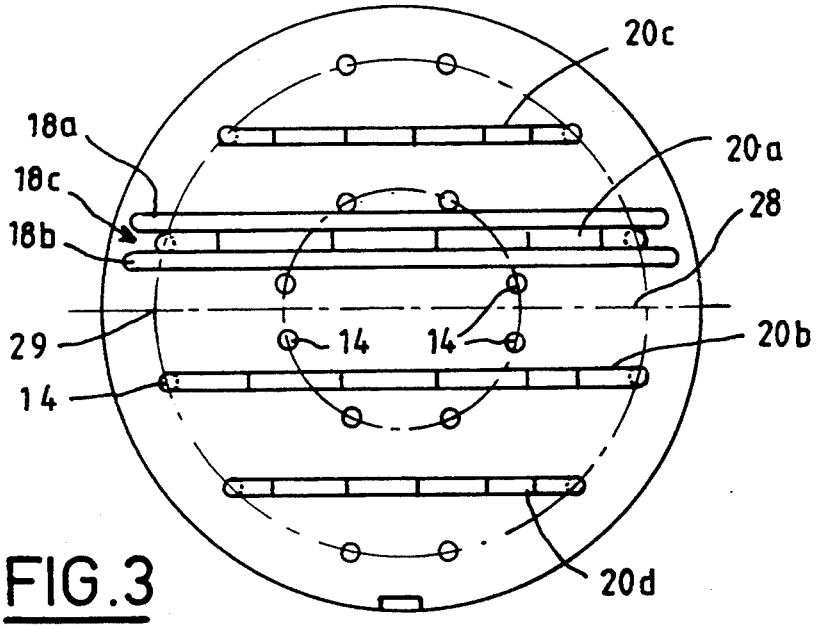
FIG. 3 is a plan view in the direction of arrow 3 in FIG. 2.

FIG. 3 shows a plan view of four retainer hoops 20*a*, 20*b*, 20*c* and 20*d* of a steam generator produced according to the invention, the retainer hoops 20*a* and 20*b*, on the one hand, and 20*c* and 20*d*, on the other hand, being symmetrical to each other with respect to the central lane of the steam generator whose axis 28 has been represented in FIG. 3.

To show the retainer hoops 20*a* to 20*d* arranged inside the tube bend region of the bundle of the steam generator, only two tube rows 18*a* and 18*b* have been represented, located on either side of a row 18*c* in which the retainer hoop 20*a* is interposed.

The upper spacer plate 10*a* of the steam generator is pierced by openings arranged in a network allowing passage of the tubes of the bundle and anchor rods for fastening the spacer plates.

FIG. 3 represents only the end parts of the anchor rods 14 fixed on the spacer plate 10*a*. The retainer hoops 20*a*, 20*b*, 20*c* and 20*d* are fixed by their ends on the spacer plate 10*a*, each in extension of two anchor rods 14.

The anchor rods 14, in extension of which the retainer hoops are fixed, are all arranged in a circle 29 which is concentric with the spacer plate 10*a*.

In the case of the steam generator represented in FIG. 3, eight sets of antivibration bars arranged between rows 18 of the bundle are held in place by the two large retainer hoops 20*a* and 20*b* arranged in the vicinity of the central lane 28 and by the two small retainer hoops 20*c* and 20*d* placed in positions further from the central lane 28.

The retainer hoops 20*a* and 20*b*, on the one hand, and 20*c* and 20*d*, on the other hand, can be assembled and fitted, during mounting of the tubes of the steam generator, by connecting modular segments in the shape of circular arcs, including assembly means at their end part. The assembled retainer hoops can be fixed on the spacer plate 10*a* and tensioned by fastening devices 19 connected the end parts of the corresponding anchor rods 14.

A large number of antivibration bars are therefore fitted precisely and fastened during the mounting of the bundle of the steam generator, which makes it possible to ensure greater rigidity of the successive plane tube rows and of the entirety of the tube bend region.

During the workshop operations necessary for manufacture of the steam generator, accompanied by displacements of the bundle in rotation about its axis which is placed in a horizontal arrangement, the antivibration bars are held efficiently so that they can no longer tilt between the tube rows.

These antivibration bars are also held so that they can no longer be displaced by sliding and penetrate further into the tube bend region.

In general, during mounting of the bundle and of the steam generator, better fitting and efficient holding of the antivibration bars introduced into the tube bend region of the steam generator are more easily ensured.

The retainer hoops for fastening the antivibration bars of the steam generator according to the invention are, of course, left in place in the tube bend region after mounting of the steam generator, so that these retainer hoops also hold the antivibration bars and stiffen the tube bend region of the steam generator during operation of this generator.

In the event the steam nozzle of the generator breaks, the metal retainer hoop according to the invention holds in place the elements attached in the tube bend region of the steam generator (antivibration bars) and thus provides the anti-flyoff function.

Obtaining and maintaining of the geometrical characteristics of the bundle of the steam generator are therefore ensured highly efficiently in steam generators according to the invention.

The, retainer hoops may be in a form different from that which has been described, this modular embodiment having the advantage of simultaneously assembling and adapting the retainer hoops and fastening the antivibration bars.

Similarly, the devices for fastening the retainer hoops on the upper spacer plate in extension of the anchor rods may be different from the tensioners 19 which were described hereinabove.

Any number of retainer hoops for fastening the antivibration bars and stiffening may be placed inside the tube bend region of the bundle of the steam generator, this number depending on the number and position of the anchor rods for holding the spacer plates which substitute for certain tubes of the bundle.

In certain cases, the use of just one retainer hoop may be used for fastening and stiffening. Generally, because of the symmetry of the bundle of steam generators, an even number of retainer hoops for fastening and stiffening are used, arranged pairwise symmetrically with respect to the plane of symmetry of the bundle.

The invention applies not only to steam generators of pressurized water nuclear reactors but also to other steam generators or heat exchangers including a bundle of bent tubes arranged in mutually parallel plane rows.

I claim:

1. Heat exchanger including a bundle of heat-exchange tubes bent in a U and each comprising two straight parts and a bent part, a tube plate and a plurality of spacer plates which are mutually parallel and spaced along the longitudinal direction of the straight parts of the tubes, in which plates the tubes of the bundle are engaged inside through-openings which hold the tubes in mutually parallel plane rows, anchor rods for holding the spacer plates, which rods are arranged inside the bundle, parallel to the straight parts of the tubes, and sets of antivibration bars interposed between the bent parts of the tubes and arranged along adjacent rows, means for holding at least one set of antivibration bars arranged between the tubes of two adjacent rows, said means comprising at least one metal retainer hoop having a shape similar to the shape of the bent parts of the tubes, of the bundle, fixed at each of its ends to the spacer plate located closest to the bent parts of the tubes, in extension of two of said anchor rods, and interposed between two tubes of a row of tubes and including means for fastening the set of antivibration bars interposed between the row in which the retainer hoop is arranged in at least one adjacent row.

2. Heat exchanger according to claim 1, wherein the metal retainer hoop consists of successive segments assembled together by assembly devices which also fix the antivibration bars.

3. Heat exchanger according to claim 2, wherein the retainer hoop, having a semicircular shape, consists of successive segments in the form of circular arcs.

4. Heat exchanger according to claim 2 or 3, wherein the successive segments of the retainer hoop are assembled together by screwing and include assembly parts between which the antivibration bars are clamped.

5. Heat exchanger according to any one of claim 1 to 3, wherein the retainer hoop is fixed at each of its ends onto the spacer plate, by means of fastening devices constituting tensioners for exerting tension on the ends of the retainer hoop.

6. Heat exchanger according to claim 5, wherein the fastening devices include a first element comprising means of fastening on the spacer plate and a tapped bore, a rod comprising two threaded parts with reverse thread and a nut between the two threaded parts and a second element constituting an end segment of the retainer hoop and including a tapped opening, for the threaded rod being to screwed simultaneously by its threaded parts with reverse thread into the tapped openings of the first element integral with the support plate and of the second element constituting an end segment of the retainer hoop.

7. Heat exchanger according to claim 6, wherein the means of fastening the first element on the spacer plate is a tapped bore which can be screwed onto a threaded part of and anchor rod passing through the spacer plate.

8. Heat exchanger according to any one of claim 1 to 3, including it includes at least two retainer hoops arranged symmetrically with respect to a plane of symmetry of the bundle of the steam generator.

9. Use of a heat exchanger according to any one of claim 1 to 3 as steam generator of a pressurized water nuclear reactor.

* * * * *